US006205648B1

(12) United States Patent
Hughes

(10) Patent No.: US 6,205,648 B1
(45) Date of Patent: Mar. 27, 2001

(54) ELECTRIC HEATER UNIT AND METHOD OF MANUFACTURE

(75) Inventor: John Thomas Hughes, Stanford Bridge (GB)

(73) Assignee: Ceramaspeed Limited (GB)

( * ) Notice: Subject to any disclaimer, the term of this patent is extended or adjusted under 35 U.S.C. 154(b) by 0 days.

(21) Appl. No.: 09/033,791

(22) Filed: Mar. 3, 1998

(30) Foreign Application Priority Data

Mar. 21, 1997 (GB) ..... 9705923

(51) Int. Cl.[7] ..... H05B 3/00

(52) U.S. Cl. ..... 29/611; 29/831; 29/848; 219/457

(58) Field of Search ..... 29/611, 831, 848, 29/850; 219/457, 464, 467

(56) References Cited

U.S. PATENT DOCUMENTS 3,612,829 * 10/1971 Evans ..... 219/460
4,388,520 * 6/1983 McWilliams ..... 219/464
4,727,242 * 2/1988 Barfeild ..... 219/535
5,369,874 * 12/1994 McWilliams ..... 29/611
5,471,737 * 12/1995 McWilliams ..... 29/611
5,477,605 * 12/1995 McWilliams et al. ..... 29/611

FOREIGN PATENT DOCUMENTS 0041203 12/1981 (EP) .
2250669 6/1992 (GB) .
2278261 11/1994 (GB) .

OTHER PUBLICATIONS

European Search Report Dec. 4, 1998.

* cited by examiner

*Primary Examiner*—Lee Young
*Assistant Examiner*—Sean Smith
(74) *Attorney, Agent, or Firm*—Ira S. Dorman

(57) ABSTRACT

An electric heater unit is manufactured so as to form a base in a supporting dish by compacting powdered microporous insulation into the base. At least one electrical resistance heating element is supported on or adjacent to the base and a peripheral wall is formed in the supporting dish and integral with the base by compacting further microporous insulation material into the dish to a controlled compaction density. The compaction density of the peripheral wall may be different from that of the base, for example higher.

26 Claims, 6 Drawing Sheets

ELECTRIC HEATER UNIT AND METHOD OF MANUFACTURE

This invention relates to an electric heater unit, particularly but not exclusively for use in glass-ceramic cooking appliances, and a method for manufacture thereof.

DESCRIPTION OF PRIOR ART

Heaters for use in glass-ceramic surface electric cooking equipment are well known, having an insulation material in the shape of a bowl comprising a base and peripheral wall, the base supporting, or having adjacent thereto, one or more heating conductors in the form of an electrical resistance material formed as a wire coil, a ribbon, a halogen infra red tube or other means.

The electrical and thermal insulation material is a critical component. At least a part of the base insulation may be a high performance insulation which is a compacted microporous material.

The term 'microporous' is used herein to identify porous or cellular materials in which the ultimate size of the cells or voids is less than the mean free path of an air molecule at NTP, i.e. of the order of 100 nm or smaller. A material which is microporous in this sense will exhibit very low transfer of heat by air conduction (that is, due to collisions between air molecules). Such microporous materials include aerogel, which is a gel in which the liquid phase has been replaced by a gaseous phase in such a way as to avoid the shrinkage which would occur if the gel were dried directly from a liquid. A substantially identical structure can be obtained by controlled precipitation from solution, the temperature and pH being controlled during precipitation to obtain an open lattice precipitate. Other equivalent open lattice structures include pyrogenic (fumed) and electro-thermal types in which a substantial proportion of the particles have an ultimate size less than 100 nm. Any of these materials, based, for example on silica, alumina, other metal oxides, or carbon, may be used to prepare a composition which is microporous as defined above.

Optionally a binder may be added to provide increased strength, in which case a heat treatment may be necessary in order to cure the binder.

A known form of high performance microporous thermal insulation material comprises microporous silica particles compacted to consolidate the material into a handleable form, and typically includes ceramic fibre or glass filament reinforcement and rutile powder opacifier.

The microporous insulation may be directly in contact with the heating conductor, acting as a support for the conductor.

Alternatively the conductor may be supported by a lesser thermal insulation material which has mechanical properties quite different from the microporous thermal insulation. In this case the base support and peripheral wall may be formed as one piece with the wall and base being a homogeneous material.

When the base is a microporous insulation it has been found to be advantageous to have the peripheral wall made from a separate stronger material. Heaters have been made which have wall and base support formed as pressed microporous insulation material but the walls were mechanically weak and a stronger material was fitted to the top of the peripheral wall to improve handle ability.

Another design idea uses a microporous base support with a separate wall component also made from microporous insulation. It is claimed that the separate wall component can be made with high mechanical strength and good insulation properties. The higher strength is achieved by a special hardening process. This solution is costly. The wall component is slow to produce and needs care in handling.

OBJECT OF THE INVENTION

It is an object of the present invention to provide a high strength microporous wall component at low cost.

SUMMARY OF THE INVENTION

According to one aspect of the present invention there is provided an electric heater unit comprising a supporting dish having therein a base of compacted microporous insulation material, at least one electrical resistance heating element supported relative (that is, on or adjacent) to the base, and a peripheral wall of compacted microporous insulation material, wherein the peripheral wall is integral with the base and is of controlled compaction density.

According to a further aspect of the invention there is provided a method of manufacturing an electric heater unit comprising the steps of providing a supporting dish, forming in the supporting dish a base by compacting powdered microporous insulation material therein, providing at least one electrical resistance heating element supported relative (that is, on or adjacent) to the base, and forming in the supporting dish a peripheral wall integral with the base by compacting further microporous insulation material into the dish to a controlled compaction density.

The compaction density of the peripheral wall may be different from that of the base. For example, the peripheral wall may be of higher compaction density than the base.

In one embodiment of the method according to the invention a press tool is provided having separable central and surrounding peripheral portions, powdered microporous insulation material is compacted into the supporting dish with the press tool to form the base and, optionally, part of the peripheral wall, the peripheral portion of the press tool is retracted to form a cavity into which further powdered microporous insulation material is introduced, the peripheral portion of the press tool is advanced to compact the further powdered microporous insulation material to a controlled compaction density to form the peripheral wall integral with the base, and the central and peripheral portions of the press tool are retracted from the dish.

In a further embodiment of the method according to the invention, powdered microporous insulation material is compacted into the supporting dish with a press tool to form the base and, optionally, part of the peripheral wall, the press tool and the dish are then separated and a further press tool having separable central and surrounding peripheral portions is provided, at least one electrical resistance heating element is supported at a face of the central portion of the press tool and is pressed by the press tool into the surface of the base of compacted microporous insulation material in the supporting dish for partial embedding therein, the peripheral portion of the further press tool is retracted to form a cavity into which further powdered microporous insulation material is introduced, the peripheral portion of the further press tool is advanced to compact the further powdered microporous insulation material to a controlled compaction density to form the peripheral wall integral with the base, and the central and peripheral portions of the further press tool are retracted from the dish, leaving the heating element securely partially embedded in the base.

The powdered microporous insulation material (including, optionally, the further powdered microporous insulation material) may be introduced into the press tool by way of a tube through a wall thereof. The powdered material may be pumped through the tube such as by using high pressure gas induction or by using a vane pump, a diaphragm pump or a peristaltic pump.

The supporting dish may be circular and the press tool with separable central and surrounding peripheral portions may have a circular central portion and an annular surrounding peripheral portion.

The further powdered microporous insulation material may have a composition substantially the same as, or different from, that of the material forming the base.

The peripheral wall of compacted microporous insulation material preferably is under internal compressive strain after provision in the supporting dish.

The peripheral wall is suitably arranged to have a top surface capable of contacting the underside of a glass-ceramic cook top of a cooking appliance, in particular the peripheral wall may have a height at least as great as the height of side walls of the supporting dish. Such top surface may be profiled such that it is higher at its centre than at its edges.

The peripheral wall and/or the base may include reinforcing glass filaments. Such filaments may, for example, be selected from E glass, R glass, S glass and silica.

The supporting dish may comprise a metal.

The at least one electrical resistance heating element may, for example, comprise coiled wire or coiled ribbon, or plane or corrugated ribbon, disposed flat or edgewise relative (that is, on or adjacent) to the base in the supporting dish.

By means of the invention a peripheral wall of microporous insulation material is provided in which the composition and the compaction density thereof are the same as or different from a base of microporous insulation material with which it is integrally provided.

The invention is now described by way of example with reference to the accompanying drawings, in which:

DESCRIPTION OF PREFERRED EMBODIMENTS

Figure 1:
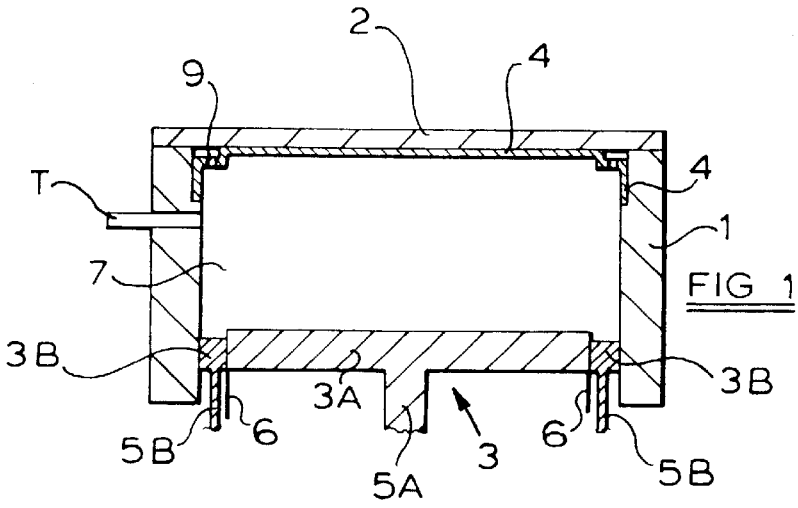
FIGS. 1 to 7 are cross-sectional views of an arrangement illustrating process steps in the manufacture of an electric heater unit according to the invention.

Referring to FIG. 1, a press for use in manufacturing an electric heater unit according to the invention comprises a housing 1, a cover 2 and a press tool 3 which is slidable inside the housing 1. The end of the housing 1 is recessed to receive the rim of a metal dish 4 which will form the supporting dish for the electric heater unit.

The press tool 3 is of circular shape and comprises a circular central portion 3A and an annular surrounding peripheral portion 3B. The central portion 3A and annular portion 3B are separable from one another and are slidable in the housing by means of plungers 5A and 5B.

The central portion 3A has an extended cylindrical wall 6 able to slidably interface with the annular portion 3B.

Operation of the press commences with retraction of the press tool 3 to the position shown in FIG. 1.

A predetermined quantity of powdered microporous thermal insulation material is introduced into the space 7 between the press tool 3 and the dish 4. By way of example only, the insulation material may have the following composition:

| | |
|---|---|
| Pyrogenic silica | 60 percent by weight |
| Opacifier (Rutile) | 37 percent by weight |
| Ceramic fibres | 3 percent by weight |

The powdered material may be introduced into the space 7 before the dish 4 and cover 2 are installed. Alternatively it may be pumped into the space 7 by way of a tube T passing through the wall of the housing 1. Pumping of the powder through the tube T may be by using high pressure gas induction or using a vane pump, a diaphragm pump, or a peristaltic pump.

Figure 2:
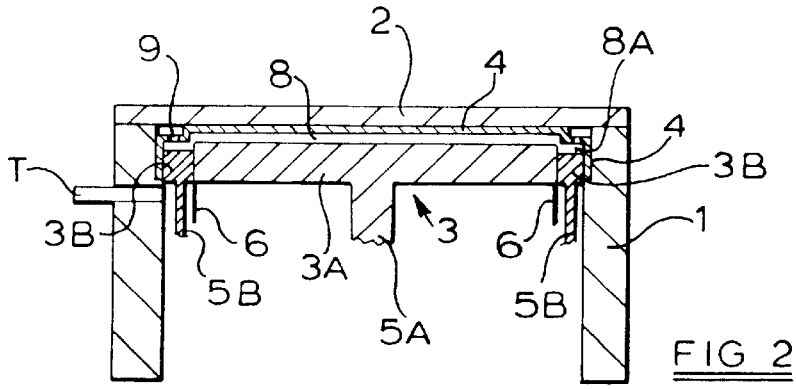

The press is operated, for example hydraulically, to urge both portions 3A and 3B of the press tool simultaneously towards the dish 4, by means of the plungers 5A and 5B, as shown in FIG. 2, thereby compacting the insulation material into the dish 4 to form a base 8 in the dish.

During the compacting operation, air is displaced from the press through holes 9 at the periphery of the dish 4 and also via the interface between the press tool 3 and the housing 1. If required, holes (not shown) may be provided through the press tool 3 to further facilitate air displacement.

The compacted insulation material forming the base 8 may be formed with a step 8A at the edge thereof, by forming a complementary step in the press tool 3. Such step 8A forms a base portion of a peripheral wall of insulation material which is to be provided in the dish as hereinafter described.

Figure 3:
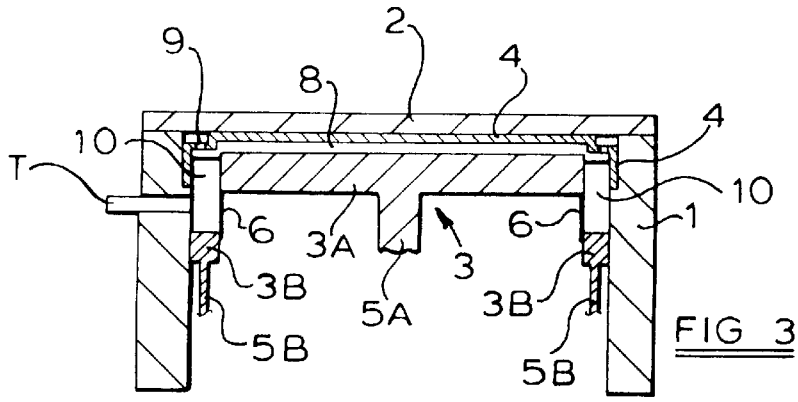

As shown in FIG. 3, the next step in the process is to retract the annular portion 3B of the press tool, by means of the plungers 5B while leaving the central portion 3A of the press tool in contact with the surface of the base 8 of insulation material. Further powdered microporous insulation material is then pumped through the tube T into the space 10 vacated by the annular portion 3B of the press tool.

Figure 4:
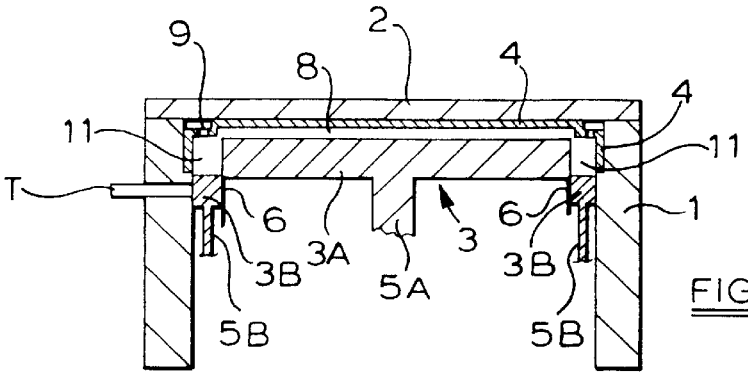

As shown in FIG. 4, the annular portion 3B of the press tool is then advanced towards the dish 4 to compact the further insulation material to form a peripheral wall 11 of microporous insulation material integrally moulded with the base 8 of microporous insulation material. The wall 11 is arranged to be compacted to a higher compaction density than that on average of the base 8. For example the base 8 may have a compaction density of about 300 $kg/m^3$ whereas the wall 11 may be compacted to a density of about 350 $kg/m^3$.

The wall 11 may have a composition the same as, or different from, that of the base 8. An example of a particular composition for the wall is:

| | |
|---|---|
| Pyrogenic silica | 62 percent by weight |
| Opacifier (Rutile) | 27 percent by weight |
| E glass filaments | 11 percent by weight |

Figure 5:
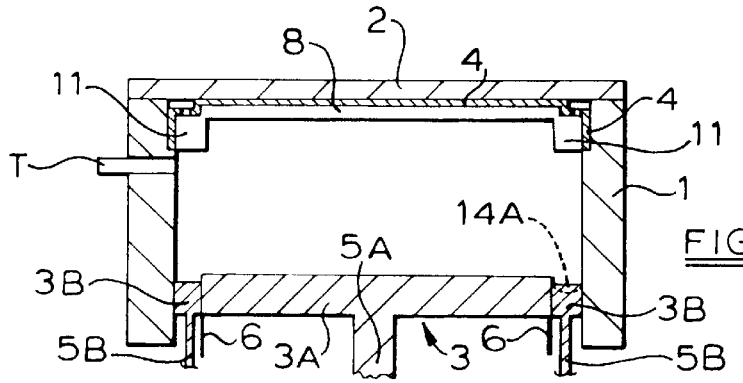
Figure 6:
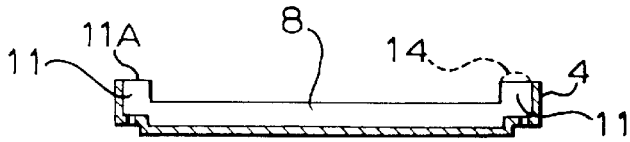

Both portions 3A, 3B of the press tool are then retracted as shown in FIG. 5, the cover 2 is removed and the dish 4 with the base 8 and peripheral wall 11 therein is extracted. The dish 4 with the base 8 and peripheral wall 11 therein is shown in FIG. 6. The peripheral wall 11 has a height corresponding at least to the height of side walls of the dish 4, and preferably extending somewhat above the side walls of the dish 4.

Figure 7:
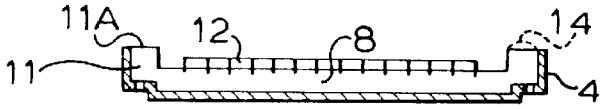

To complete the heater unit, an electrical resistance heating element 12 is provided supported on the base 8 of microporous thermal insulation material as shown in FIG. 7. Heating element 12 may comprise any of the well known forms, such as coiled wire or ribbon or a corrugated ribbon supported edgewise and partly embedded in the base 8. Such a corrugated ribbon form of element is shown in FIG. 7 and also in FIG. 16, which represents a plan view of the heater of FIG. 7 and in which there is additionally provided a well known form of temperature limiter 13.

Figure 16:
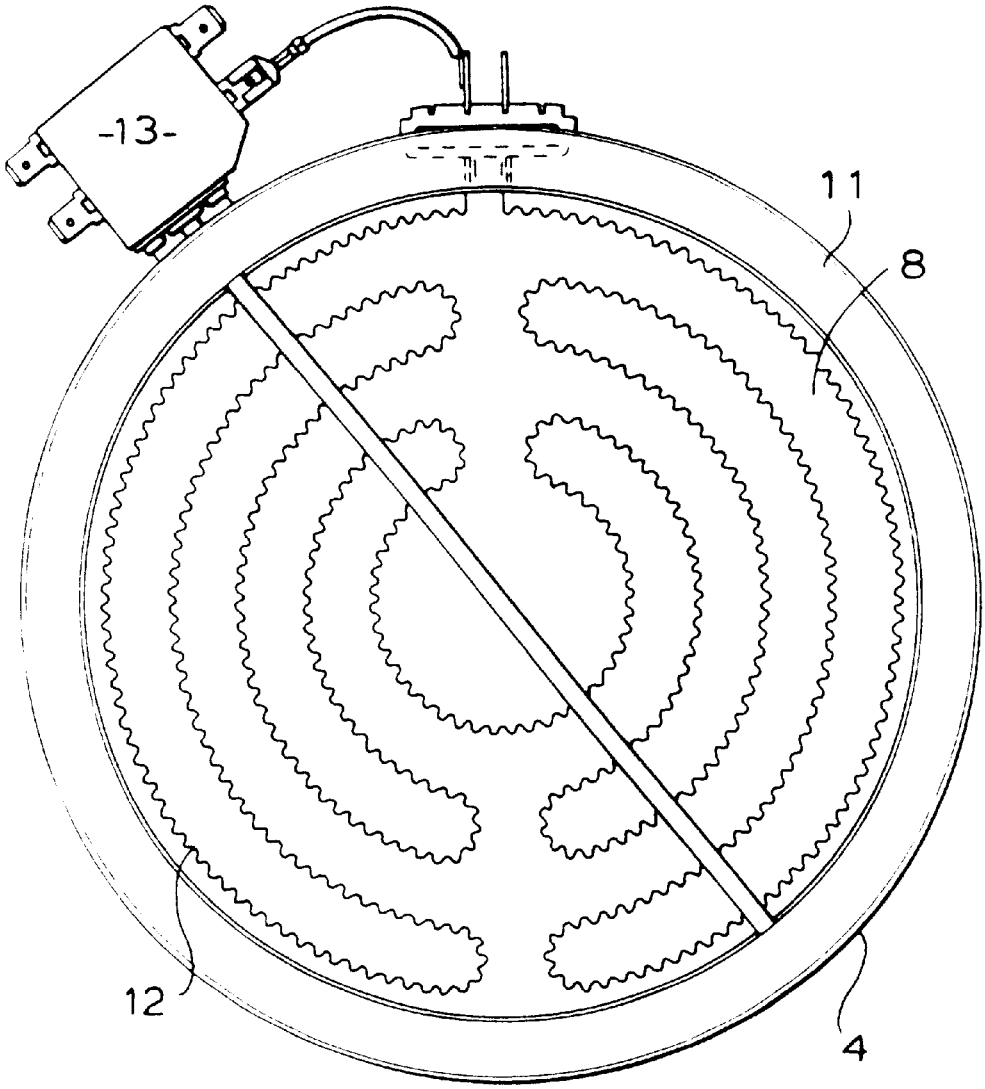
FIG. 16 is a plan view of an embodiment of electric heater unit manufactured according to the invention.

The heater of FIGS. 7 and 16 is intended for operation in a glass-ceramic top cooking appliance (not shown) where it is secured beneath a glass-ceramic cook top (not shown) with the upper surface 11A of the peripheral wall in contact with the underside of the glass-ceramic top.

As shown by the dotted outline 14 in FIGS. 6 and 7, the top surface of the peripheral wall 11 may be profiled such that it is higher at its centre than at its edges. This is achieved by providing a complementary profile on the inner face 14A of the annular portion 3B of the press tool (FIG. 5).

FIGS. 8 to 15 illustrate an alternative process sequence including the moulding of corrugated ribbon heating element 12 into base 8 of microporous insulation material.

Figure 8:
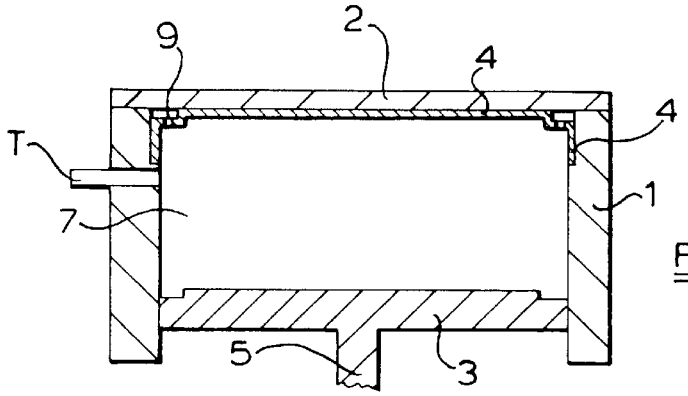
FIGS. 8 to 15 are cross-sectional views of a further arrangement illustrating process steps in the manufacture of an electric heater unit according to the invention.

Referring to FIG. 8, a press is provided, as in FIG. 1, comprising a housing 1 recessed to receive the rim of a metal dish 4 forming the supporting dish of an electric heater unit. A cover 2 is provided for the housing. A circular press tool 3 is provided, slidable in the housing 1 by means of a plunger 5.

Figure 9:
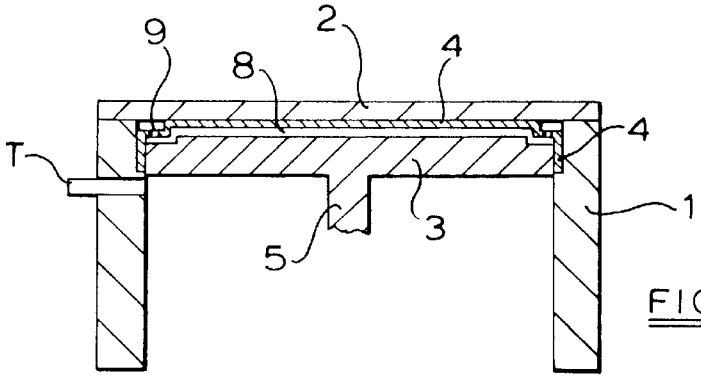
Figure 10:
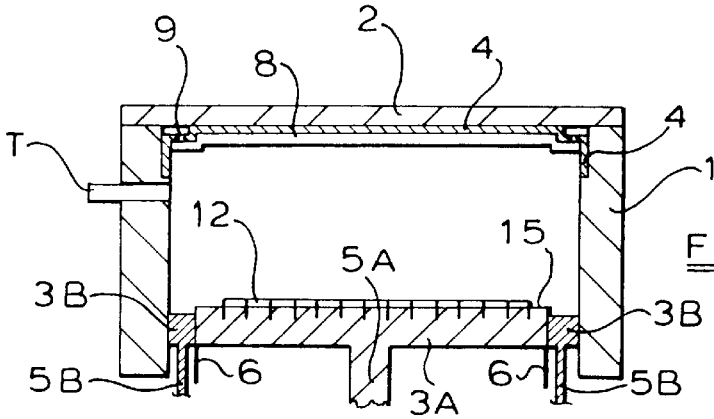
Figure 11:
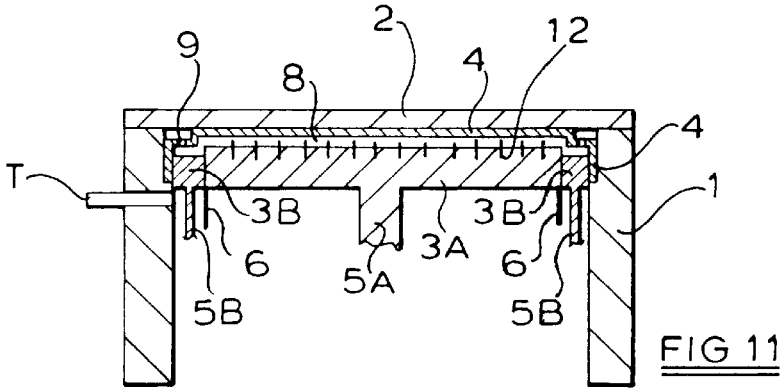

With the press tool in the position shown in FIG. 8, a predetermined quantity of powdered microporous thermal insulation material is introduced into the space 7 between the press tool 3 and the dish 4 using either of the methods as previously described with reference to FIG. 1. The press is operated to urge the press tool 3 towards the dish 4, as shown in FIG. 9, thereby compacting the insulation material into the dish 4 to form a base 8 in the dish. The press tool 3 is then withdrawn from the housing and replaced by the press tool shown in FIG. 10, which is of two part form as previously described with reference to FIG. 1, having a central circular portion 3A operated by a plunger 5A and an annular peripheral portion 3B operated by plungers 5B. The top surface 15 of the central portion 3A of the press tool is provided with a pattern of grooves to partially receive therein a corrugated ribbon heating element 12. The press tool 3A, 3B is advanced by means of plungers 5A, 5B towards the base 8 of compacted insulation material, as shown in FIG. 11, to cause the heating element 12 to be partially embedded in the surface of the base 8. It may be advantageous if, during the initial provision of the base 8, as described with reference to FIGS. 8 and 9, the microporous insulation material of the base 8 is compacted to less than its required final density. This facilitates embedding of the heating element 12 therein and subsequent to such embedding, the base 8 is compacted to its desired final density by pressure exerted thereon by the surface of the press tool 3A, 3B.

Figure 12:
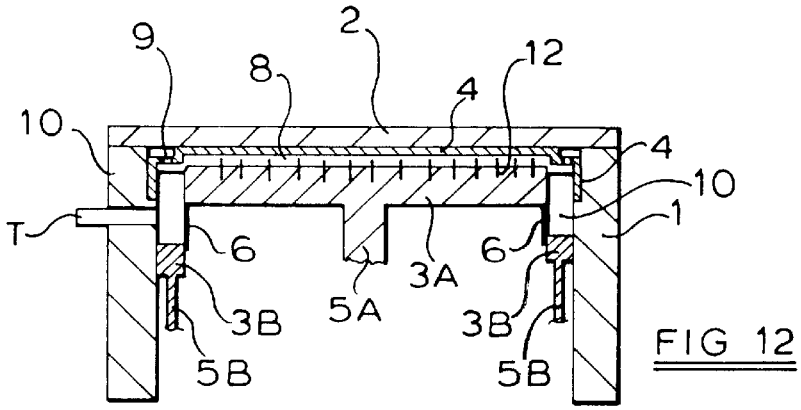

With the central portion 3A of the press tool retained in the position shown in FIG. 11, the annular peripheral portion 3B of the press tool is retracted by the plungers 5B into the position shown in FIG. 12. Further powdered microporous insulation material is then pumped through tube T into the space 10 vacated by the annular portion 3B of the press tool.

Figure 13:
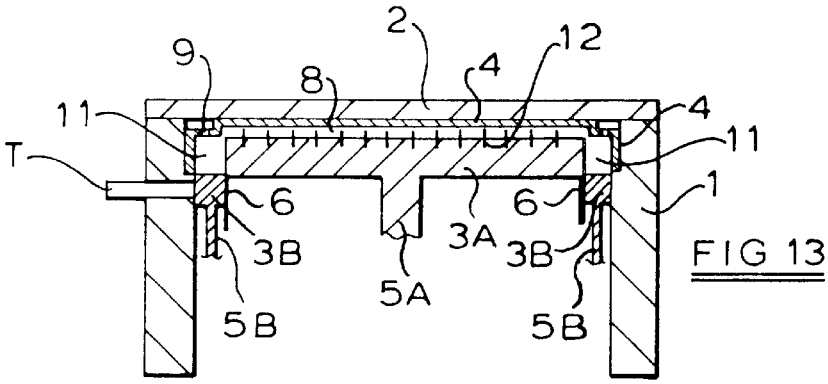

As shown in FIG. 13, the annular portion 3B of the press tool is then advanced towards the dish 4 to compact the further insulation material to form a peripheral wall 11 of microporous insulation material integrally moulded with the base 8 of microporous insulation material. The wall 11 is arranged to be compacted to a higher compaction density than that on average of the base 8.

The wall 11 may have a composition the same as, or different from, that of the base 8.

Figure 14:
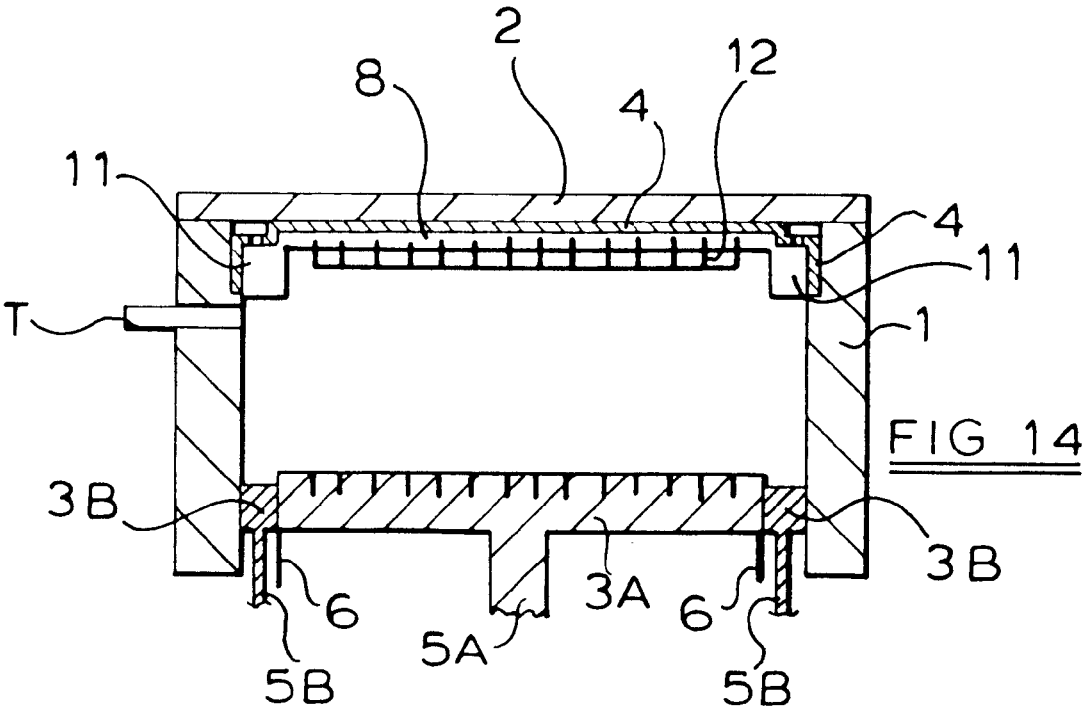
Figure 15:
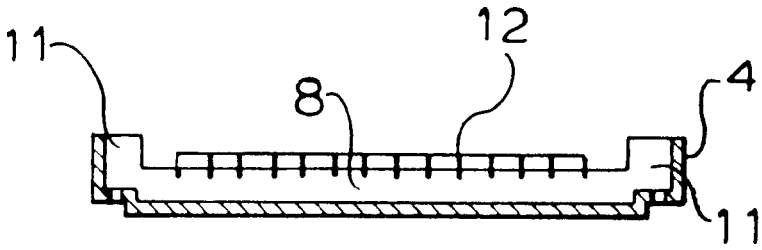

Both portions 3A, 3B of the press tool are then retracted as shown in FIG. 14, leaving the heating element 12 securely partially embedded in the base 8. It is preferred that the central portion 3A of the press tool is retracted before the annular portion 3B to minimise risk of damage to material of the wall 11. The cover 2 is removed from the press and the heater unit comprising the dish 4, with the base 8, peripheral wall 11 and heating element 12, extracted. Such heater unit is shown in section in FIG. 15 and, after the addition of a temperature limiter 13, in plan view in FIG. 16.

What is claimed is:

1. A method of manufacturing an electric heater comprising the steps of providing a supporting dish, forming in the supporting dish a base by compacting powdered microporous insulation material therein, providing at least one electrical resistance heating element supported relative to the base, and forming in the supporting dish a peripheral wall integral with the base, and having a density higher than that of the base, by compacting further microporous insulation material into the dish to a controlled density higher than the density of the base.

2. A method according to claim 1, wherein a press tool is provided having separable central and surrounding peripheral portions, powdered microporous insulation material is compacted into the supporting dish with the press tool to form the base, the peripheral portion of the press tool is retracted to form a cavity into which further powdered microporous insulation material is introduced, the peripheral portion of the press tool is advanced to compact the further powdered microporous insulation material to a controlled compaction density to form the peripheral wall integral with the base, and the central and peripheral portions of the press tool are retracted from the dish.

3. A method according to claim 2, wherein powdered microporous insulation material is compacted into the supporting dish with the press tool to form part of the peripheral wall simultaneously with the base.

4. A method according to claim 2, wherein the powdered microporous insulation material is introduced into the press tool by way of a tube through a wall thereof.

5. A method according to claim 4, wherein the powdered material is pumped through the tube.

6. A method according to claim 5, wherein the material is pumped by means selected from high pressure gas induction, a vane pump, a diaphragm pump and a peristaltic pump.

7. A method according to claim 2, wherein the supporting dish is circular and the press tool with separable central and surrounding peripheral portions has a circular central portion and an annular surrounding peripheral portion.

8. A method according to claim 1, wherein powdered microporous insulation material is compacted into the supporting dish with a press tool to form the base, the press tool and the dish are then separated and a further press tool having separable central and surrounding peripheral portions is provided, at least one electrical resistance heating element is supported at a face of the central portion of the press tool and is pressed by the press tool into the surface of the base of compacted microporous insulation material in the supporting dish for partial embedding therein, the peripheral portion of the further press tool is retracted to form a cavity into which further powdered microporous insulation material is introduced, the peripheral portion of the further press tool is advanced to compact the further powdered microporous insulation material to a controlled compaction density to form the peripheral wall integral with the base, and the central and peripheral portions of the further press tool are retracted from the dish, leaving the heating element securely partially embedded in the base.

9. A method according to claim 8, wherein powdered microporous insulation material is compacted into the supporting dish with the press tool to form part of the peripheral wall simultaneously with the base.

10. A method according to claim 8, wherein the powdered microporous insulation material is introduced into the press tool by way of a tube through a wall thereof.

11. A method according to claim 10, wherein the powdered material is pumped through the tube.

12. A method according to claim 11, wherein the material is pumped by means selected from high pressure gas induction, a vane pump, a diaphragm pump and a peristaltic pump.

13. A method according to claim 8, wherein the supporting dish is circular and the press tool with separable central and surrounding peripheral portions has a circular central portion and an annular surrounding peripheral portion.

14. A method according to claim 1, wherein the further microporous insulation material has a composition substantially the same as that of the material forming the base.

15. A method according to claim 1, wherein the further microporous insulation material has a composition different from that of the material forming the base.

16. A method according to claim 1, wherein the peripheral wall of compacted microporous insulation material is under internal compressive strain after provision in the supporting dish.

17. A method according to claim 1, wherein the peripheral wall is arranged to have a top surface at least part of which is capable of contacting the underside of a glass ceramic cook top of a cooking appliance.

18. A method according to claim 17, wherein the peripheral wall has a height at least as great as the height of side walls of the supporting dish.

19. A method according to claim 12, wherein the top surface of the peripheral wall is profiled such that it is higher at its centre than at its edges.

20. A method according to claim 1, wherein the peripheral wall includes reinforcing glass filaments.

21. A method according to claim 20, wherein the reinforcing glass filaments are selected from E glass, R glass, S glass and silica.

22. A method according to claim 1, wherein the base includes reinforcing glass filaments.

23. A method according to claim 22, wherein the reinforcing glass filaments are selected from E glass, R glass, S glass and silica.

24. A method according to claim 1, wherein the supporting dish comprises a metal.

25. A method according to claim 1, wherein the at least one electrical resistance heating element is selected from coiled wire, coiled ribbon, and plane or corrugated ribbon, and is disposed flat or edgewise relative to the base in the supporting dish.

26. A method of manufacturing an electric heater comprising the steps: providing a supporting dish contained in a forming space; introducing into the forming space a powdered microporous insulation material; forming in the supporting dish a base by compacting the powdered microporous insulation material therein; providing at least one electrical resistance heating element supported relative to the base; introducing into the forming space further microporous insulation material; and forming in the supporting dish a peripheral wall integral with the base, and having a density higher than that of the base, at least in part by compacting the further microporous insulation material into the dish to a controlled density higher than the density of the base.

* * * * *